US005210796A

United States Patent [19]

Hirabayashi et al.

[11] Patent Number: 5,210,796

[45] Date of Patent: May 11, 1993

[54] STEREO/MONAURAL DETECTION APPARATUS

[75] Inventors: Atsushi Hirabayashi; Kenji Komori, both of Tokyo; Kyoichi Murakami, Kanagawa, all of Japan

[73] Assignee: Sony Corporation, Tokyo, Japan

[21] Appl. No.: 785,758

[22] Filed: Oct. 31, 1991

[30] Foreign Application Priority Data

Nov. 9, 1990 [JP] Japan ..... 2-302483

[51] Int. Cl.[5] ..... H04H 5/00

[52] U.S. Cl. ..... 381/12; 381/22

[58] Field of Search ..... 381/12, 1, 21, 22

[56] References Cited

U.S. PATENT DOCUMENTS 4,236,041 11/1980 Thomas ..... 381/12
4,455,673 6/1984 Topping et al. ..... 381/12
5,046,098 9/1991 Mandell et al. ..... 381/22

FOREIGN PATENT DOCUMENTS 2439505 10/1978 France .

OTHER PUBLICATIONS

Elektronics, vol. 13, No. 147, Jul. 1987, pp. 36–37.

*Primary Examiner*—Jin F. Ng
*Assistant Examiner*—Nina Tong
*Attorney, Agent, or Firm*—Lewis H. Eslinger; Jay H. Maioli

[57] ABSTRACT

A stereo/monaural detection apparatus for detecting whether two-channel input audio signals are stereo or monaural, wherein the level difference between the input audio signals is calculated, and after the signal representing the level difference is discriminated with a predetermined hysteresis maintained, a stereo/monaural detection is performed in accordance with the result of such discrimination, thereby preventing an erroneous detection that may otherwise be caused by any level difference variation during a short time as in a case where the sound field is positioned at the center in the stereo signals. And the discrimination with the hysteresis is partially inhibited in response to the signal obtained by discriminating the level sum of the input audio signals at a predetermined reference level, hence preventing instability of the operation when the audio input level is extremely feeble.

11 Claims, 3 Drawing Sheets

LEVEL
V1
(L-R)
V2

LEVEL
(L+R)
V3

COMPARATOR OUTPUT
"H"
"L"

COMPARATOR OUTPUT
"H"
"L"

COMPARATOR OUTPUT
"H"
"L"

SWITCHING OUTPUT
"H"
"L"

HYSTERESIS OUTPUT
"H"
"L"

LEVEL RATIO
(L-R)/(L+R)
1/7

"H"
COMPARATOR OUTPUT
"L"

CAPACITOR STATE
CHARGE
DISCHARGE
CHARGE
DISCHARGE
LEVEL (V)

V4
CAPACITOR VOLTAGE

"H"
COMPARATOR OUTPUT
"L"
τ1
τ2
τ1

STEREO/MONAURAL DETECTION APPARATUS

BACKGROUND OF THE INVENTION

1. Field of the Invention

The present invention relates to a stereo/monaural detection apparatus for detecting whether an audio input is a stereo signal or a monaural signal.

2. Description of the Prior Art

There is known a technique of detecting whether a two-channel audio input is a stereo signal or a monaural signal and selectively controlling the signal processing and so forth for the audio input in accordance with the result of such detection.

It is generally noted in the recent trend that an input audio signal is so processed as to expand the sound field thereof for enhancing the acoustic reality. Such sound field expansion needs to be selectively executed in a manner to change the signal processing depending on whether the audio input is stereo or monaural. A variety of sound field expansion systems are broadly classified into a stereo system for expanding the sound field of a stereo input signal and a monaural system for expanding the sound field of a monaural input signal by processing the same to a false stereo signal or a signal of enhanced acoustic reality. The conventional circuit based on such stereo sound field expansion system functions properly with regard to a stereo audio input signal in principle, but fails to achieve a sufficient sound expansion effect in case the audio input is a monaural signal. To the contrary, when a stereo audio signal is input to the known monaural sound field expansion circuit (e.g. for a false stereo signal), there may occur some incongruous aural impression. Since different processes need to be executed individually in conformity with a stereo or monaural input audio signal, it is urgently required to contrive a stereo/monaural detection circuit which is capable of discriminating a stereo signal and a monaural signal from each other with certainty.

In case an audio input is a telecast signal, discrimination between a stereo signal and a monaural signal can be performed by detecting the presence or absence of a stereo pilot signal superimposed selectively in a broadcasting station. However, when a stereo pilot signal is superimposed despite a monaural audio signal as in a case where monaural sound is inserted partially in a stereo program, the audio input is regarded as a stereo signal due to detection of such stereo pilot signal, and therefore an improper sound field expansion is executed on the basis of the erroneous discrimination result. Furthermore, such stereo pilot signal is utilizable merely with regard to a telecast signal and is not applicable to an audio signal obtained from any other source such as a video tape recorder, a video disc or an audio disc.

For achieving the above detection from an audio input itself, there may be contrived a means of detecting a stereo or monaural signal by discrimination of the level difference between two-channel input audio signals. However, there exists a problem that even when the audio input is stereo, the signal levels of the left and right channels may become equal to each other in case the acoustic image is positioned at the center, whereby it is not distinguishable from a monaural signal. And another disadvantage is existent with regard to instability of the discrimination when the input signal is feeble.

OBJECT AND SUMMARY OF THE INVENTION

It is an object of the present invention to provide an improved stereo/monaural detection apparatus which is capable of effectively detecting whether an audio input signal supplied thereto is stereo or monaural while minimizing any harmful influence derived from erroneous detection.

According to one aspect of the present invention, there is provided a stereo/monaural detection apparatus comprising a pair of input terminals supplied with two-channel audio signals, a difference detector for detecting the level difference between the two-channel audio signals supplied to such input terminals, and a hysteresis discriminator for discriminating the level with a predetermined hysteresis given to the output signal of the difference detector. In this apparatus, the output signal of the hysteresis discriminator is used as a stereo/monaural detection signal for the two-channel audio signals supplied to the input terminals. Since the level discrimination is performed with a predetermined hysteresis given to the level difference between the two-channel input audio signals, the hysteresis is caused in the stereo/monaural detection. Therefore, an erroneous detection is preventable when the level difference is varied in a short time as in a case where the sound field is positioned at the center in the stereo signals.

According to another aspect of the present invention, the stereo/monaural detection apparatus further comprises a sum detector for calculating the level sum of the two-channel audio signals supplied to the input terminals, and a level discriminator for discriminating the output signal of the sum detector at a predetermined reference level, wherein the operation of the hysteresis discriminator in one direction is inhibited in response to the output signal of the level discriminator. For example, the discriminative switching in one direction from stereo to monaural with the hysteresis is inhibited by the signal obtained by discriminating the level sum of the input audio signals at the predetermined reference level, so that it becomes possible to prevent instability of the detection when the input level is feeble.

The above and other features and advantages of the present invention will become apparent from the following description which will be given with reference to the illustrative accompanying drawings.

BRIEF DESCRIPTION OF THE DRAWINGS

FIG. 2 is a timing chart for explaining the operation of the embodiment, in which.

DESCRIPTION OF THE PREFERRED EMBODIMENT

Hereinafter the stereo/monaural detection apparatus of the present invention will be described in detail with reference to a preferred embodiment thereof shown in the accompanying drawings.

Figure 1:
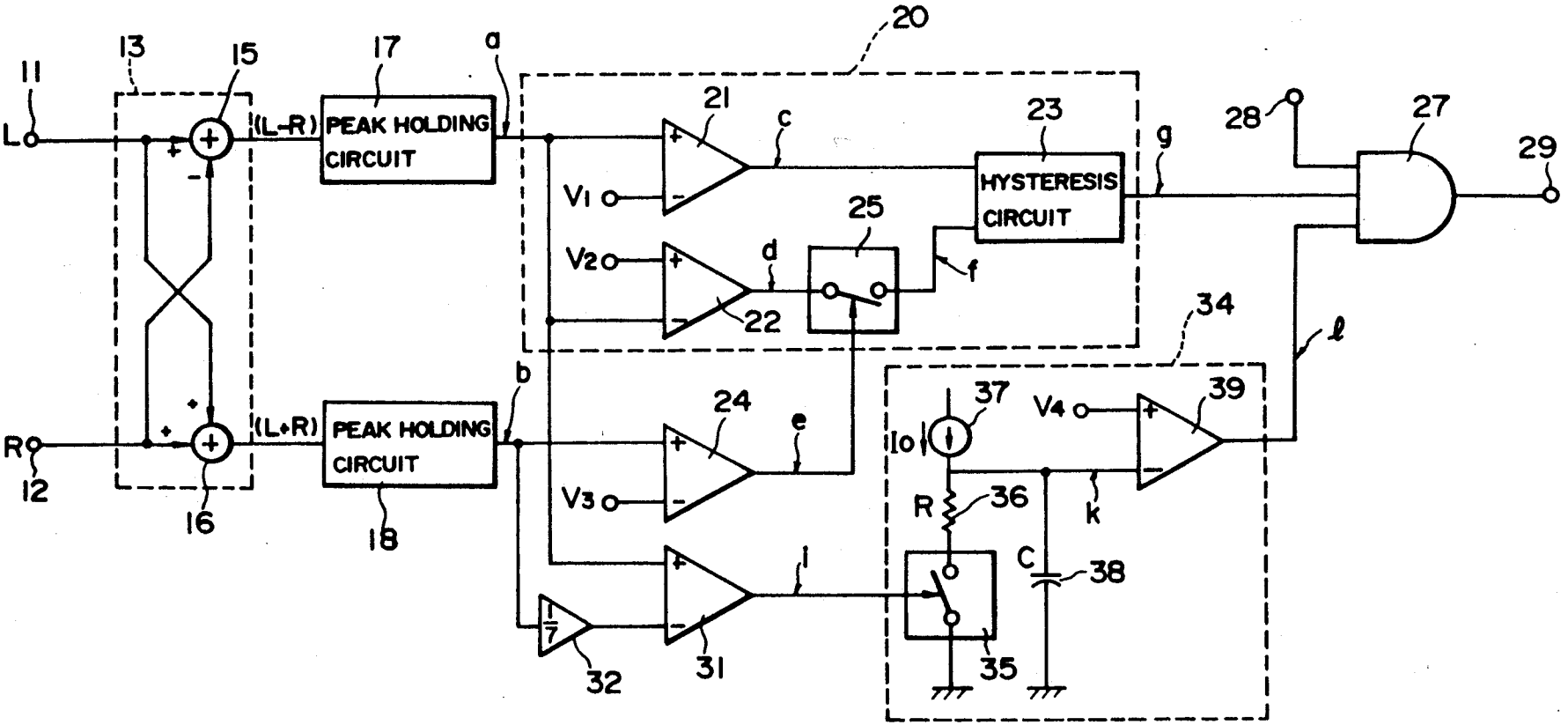
FIG. 1 is a block diagram of a stereo/monaural detection apparatus embodying the present invention.

FIG. 1 is a block diagram of the embodiment, wherein two-channel audio signals such as stereo audio signals of left and right channels or mutually equal monaural audio signals are supplied to a pair of input terminals 11, 12. The input audio signals (L, R) received at the input terminals 11, 12 are fed to a matrix circuit 13 where the difference (L−R) and the sum (L+R) of the signals are obtained. More specifically, in an adder (subtracter) 15 incorporated in the matrix circuit 13, the right-channel input signal via the terminal 12 is subtracted from the left-channel input signal (L) via the terminal 11 to produce a difference signal (L−R). Meanwhile in an adder 16, the input signal (L) via the terminal 11 and the input signal (R) via the terminal 12 are added to each other to produce a sum signal (L+R). Both the difference signal (L−R) and the sum signal (L+R) output from the matrix circuit 13 are supplied respectively to peak holding circuits 17, 18. In this embodiment, the peak holding circuits 17, 18 are used as signal level detectors which detect the positive peak values of the signals supplied thereto and hold the detected values at predetermined time constants before outputting the same. From the peak holding circuits 17, 18 are obtained output signals respectively representing the level difference and the level sum of the two-channel input audio signals (L, R).

In the embodiment of the present invention, the holding time constants of the peak holding circuits 17, 18 are set approximately to several ten milliseconds or so in such a manner that the time constant of the peak holding circuit 18 relative to the sum signal (L+R) becomes 1.3 to 1.5 times longer than that of the peak holding circuit 17 relative to the difference signal (L−R). Such setting prevents an erroneous or unstable operation that the audio input is regarded as a monaural signal when any sharp level reduction occurs due to an abrupt absence of the audio input, as will be obvious from the following description of discrimination detection. If the holding time constant is shorter than the aforesaid several ten milliseconds, an error may be induced in the discriminative detection.

In case the effect described is not necessary, the positional relation between the matrix circuit 13 and the peak holding circuits 17, 18 may be reversed so that the levels of the two-channel input audio signals are detected first and then the difference or the sum of the detected levels is calculated. Furthermore, signal level detectors such as envelope detectors may be employed in place of the peak holding circuits 17, 18.

Figures 2A, 2B, 2C, 2D, 2E, 2F, 2G:
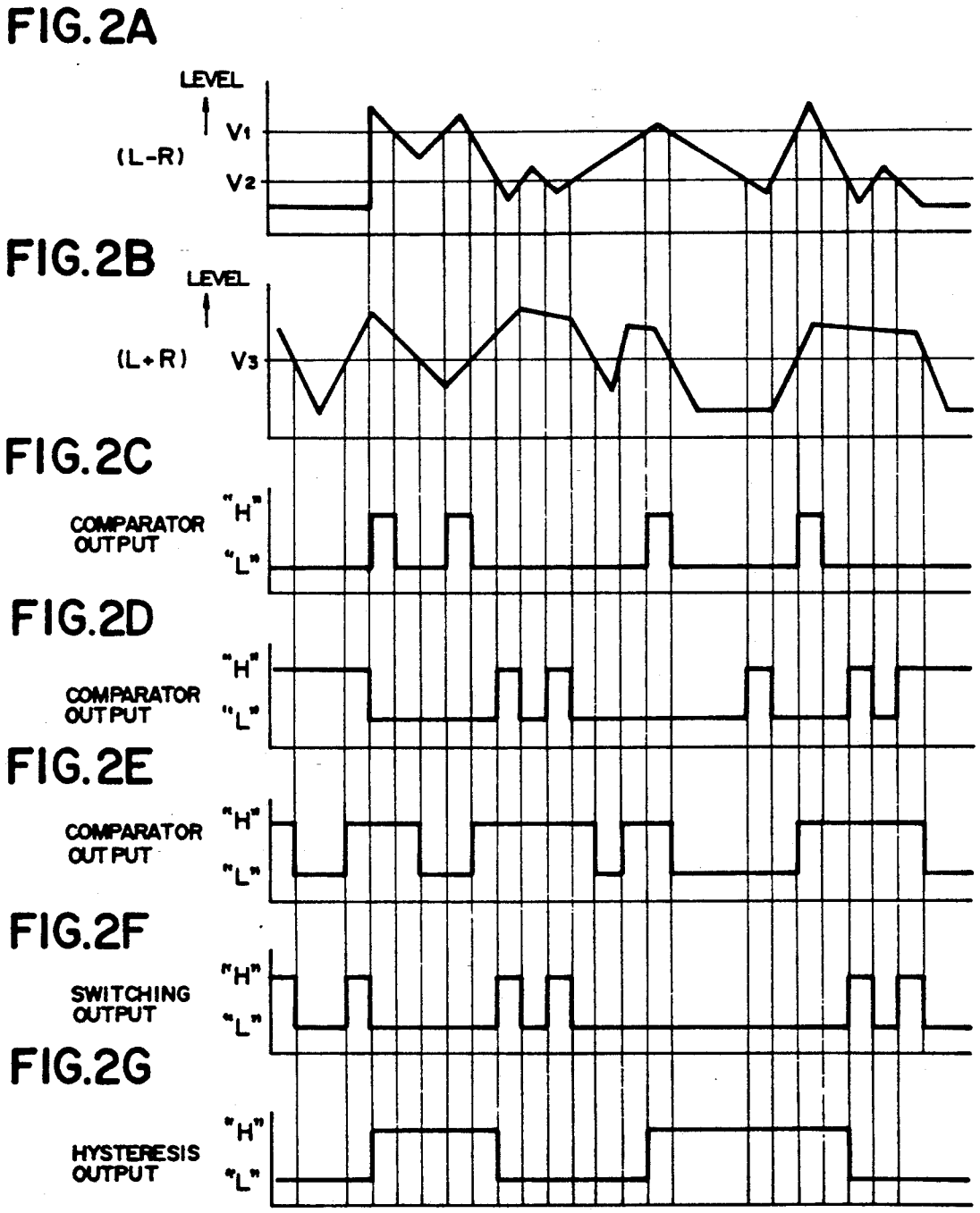
FIG. 2A shows the waveform of a difference signal of left and right channels obtained at an output terminal of a matrix circuit.
FIG. 2B shows the waveform of a sum signal of left and right channels obtained at the output terminal of the matrix circuit.
FIG. 2C shows the waveform of a signal output from a first comparator.
FIG. 2D shows the waveform of a signal output from a second comparator.
FIG. 2E shows the waveform of a signal output from a third comparator.
FIG. 2F shows the waveform of an output signal from a switching circuit connected between the second comparator and a hysteresis circuit.
FIG. 2G shows the waveform of an output signal from the hysteresis circuit.

The level difference signal thus obtained from the two-channel input audio signals (L, R), i.e., the output signal of the peak holding circuit 17, is supplied to a hysteresis discriminating circuitry 20 which performs level discrimination with a hysteresis. The hysteresis discriminating circuitry 20 comprises, for example, two comparators (level discriminators) 21, 22 and a hysteresis circuit 23. The comparator 21 serves for discrimination of the upper level of the hysteresis, wherein an inverting (−) input terminal thereof is supplied with a first reference voltage V1 corresponding to the upper level of the hysteresis. Therefore the comparator 21 performs a level discrimination in a manner that a high level ("H") output is produced when the level of the signal supplied to the noninverting (+) input terminal is above the first reference voltage V1. Meanwhile in the comparator 22, its noninverting (+) input terminal is supplied with a second reference voltage V2 which corresponds to the lower level of the hysteresis and is below the first reference voltage V1. The comparator 21 performs a level discrimination in a manner that a high level ("H") output is produced when the level of the signal supplied to the noninverting input terminal is above the second reference voltage V2. Accordingly, when a level difference signal shown in FIG. 2A is output from the peak holding circuit 17 and is supplied to the comparators 21, 22 in the hysteresis discriminating circuitry 20, then the level discrimination output (comparison output) signals obtained from the comparators 21, 22 become such as shown in FIGS. 2C and 2D respectively. Regarding the basic operation of the hysteresis circuit 23 except the action of a switch 25, a switching operation is so performed that the output is turned from a low level ("L") to a high level ("H") in accordance with a rise of the comparison output signal (FIG. 2C) obtained from the comparator 21 or is turned from "H" to "L" in accordance with a rise of the output signal (FIG. 2D) from the comparator 22. And a preliminary detection (prior to a final detection) is so executed that the audio input is a stereo signal when the output of the hysteresis circuit 23 is at "H", or the audio input is a monaural signal when such output is at "L". The hysteresis circuit 23 may be composed of a positive edge trigger type S-R (set-reset) flip-flop. In this case, the output signal of the comparator 21 is supplied to a set terminal while the output signal of the comparator 22 (obtained via the switch 25) is supplied to a reset terminal.

A circuit configuration to perform a level discrimination with a hysteresis as the hysteresis discriminating circuitry 20 in this embodiment may be composed of any of various constitutions utilizing the difference between an on-level and an off-level of a Schmitt trigger circuit.

Due to such level discrimination with a hysteresis, the audio input is detected to be stereo when the level difference between the two-channel input audio signals is above the first reference voltage V1, or is detected to be monaural when such level difference is below the second reference voltage V2. And the result of the preceding detection is retained during the state between the levels with the hysteresis maintained in the detection, so that it becomes possible to prevent any harmful influence derived from an erroneous detection when the level difference is varied in a short time as in a case where noise is superimposed or the stereo sound field is positioned at the center, thereby realizing a satisfactory stereo/monaural discriminative detection which is exact and effective in conformity with the actual circumstances.

In the embodiment of the present invention, a switch 25 is interposed between the comparator 22 and the hysteresis circuit 23 and is so connected that, when the switch 25 is turned off, the output signal of the comparator 22 is not transmitted to the hysteresis circuit 23, so as to inhibit the resetting action which turns the output state from a high level ("H") to a low level ("L"). The switch 25 is turned on and off under control in accordance with the output signal produced by discriminating the level of the sum signal (L+R) of the two-channel input audio signals at a predetermined level (third reference voltage) V3.

The level sum signal (e.g., the output signal of the peak holding circuit 18) is supplied to the noninverting (+) input terminal of the comparator (level discriminator) 24, while the third reference voltage V3 is supplied to the inverting (−) input terminal of the comparator 24. Therefore a level discrimination is so performed that a high level ("H") output is produced from the comparator 24 when the signal level (the aforementioned level sum) at the noninverting (+) input terminal thereof is above the third reference voltage V3. More specifically, if the level sum signal has the waveform of FIG. 2B, the comparison output (level discrimination output) signal of the comparator 24 becomes such as shown in FIG. 2E. And when the signal of FIG. 2E is at "H", the switch 25 incorporated in the hysteresis discriminating circuitry 20 is turned on to conduct. Since the signal of FIG. 2D is supplied from the comparator 22 to the switch 25, the output signal of the switch 25 becomes such as shown in FIG. 2F, which is then fed to the hysteresis circuit 23. Accordingly the output of the hysteresis circuit 23 is turned from "L" to "H" in synchronism with the leading edge of the signal of FIG. 2C obtained from the comparator 21, or is turned from "H" to "L" in synchronism with the leading edge of the signal of FIG. 2F obtained from the switch 25. Consequently, the output signal of the hysteresis circuit 23 becomes such as shown in FIG. 2G. This output signal signifies stereo when being at "H" or monaural when being at "L". If the hysteresis circuit 23 is composed of a leading edge trigger type S-R flip-flop, it can be supposed that the resetting thereof by the output signal of the comparator 22 is inhibited by turn-off of the switch 25. It may also be so considered that the discriminative switching from stereo to monaural is inhibited by turning off the switch 25.

In addition to the effect attained by the level discrimination with a hysteresis as described above, a further effect can be achieved as follows by the provision of the comparator 24 and the switch 25. When the level sum of the two-channel input audio signals is below the predetermined reference level V3, the switch 25 is turned off to inhibit the operation in the hysteresis discriminating circuitry 20, particularly the resetting of the hysteresis circuit 23 (i.e., discriminative switching from stereo to monaural) to thereby prevent an erroneous operation of detecting the input as a monaural signal when the level of the entire input signal is extremely feeble. Execution of this process is based on the consideration that, when the input level is feeble, a proper stereo/monaural discriminative detection is rendered difficult and an erroneous detection is prone to occur. Particularly when the aforementioned sound field expansion is selectively switched in accordance with a stereo or monaural input, it may happen that a monaural sound field expansion is performed despite a stereo input to consequently cause an incongruous aural impression. Considering any probable occurrence of such a fault, the switching operation from stereo to monaural is inhibited to prevent harmful influence that may otherwise be derived from an erroneous detection.

The output signal of the hysteresis circuit 23 represents the result of the stereo/monaural discriminative detection (preliminary to a final stereo/monaural detection) and is supplied as the output signal of the hysteresis discriminating circuitry 20 to a three-input AND gate 27.

Figures 2H, 2I, 2J, 2K, 2L:
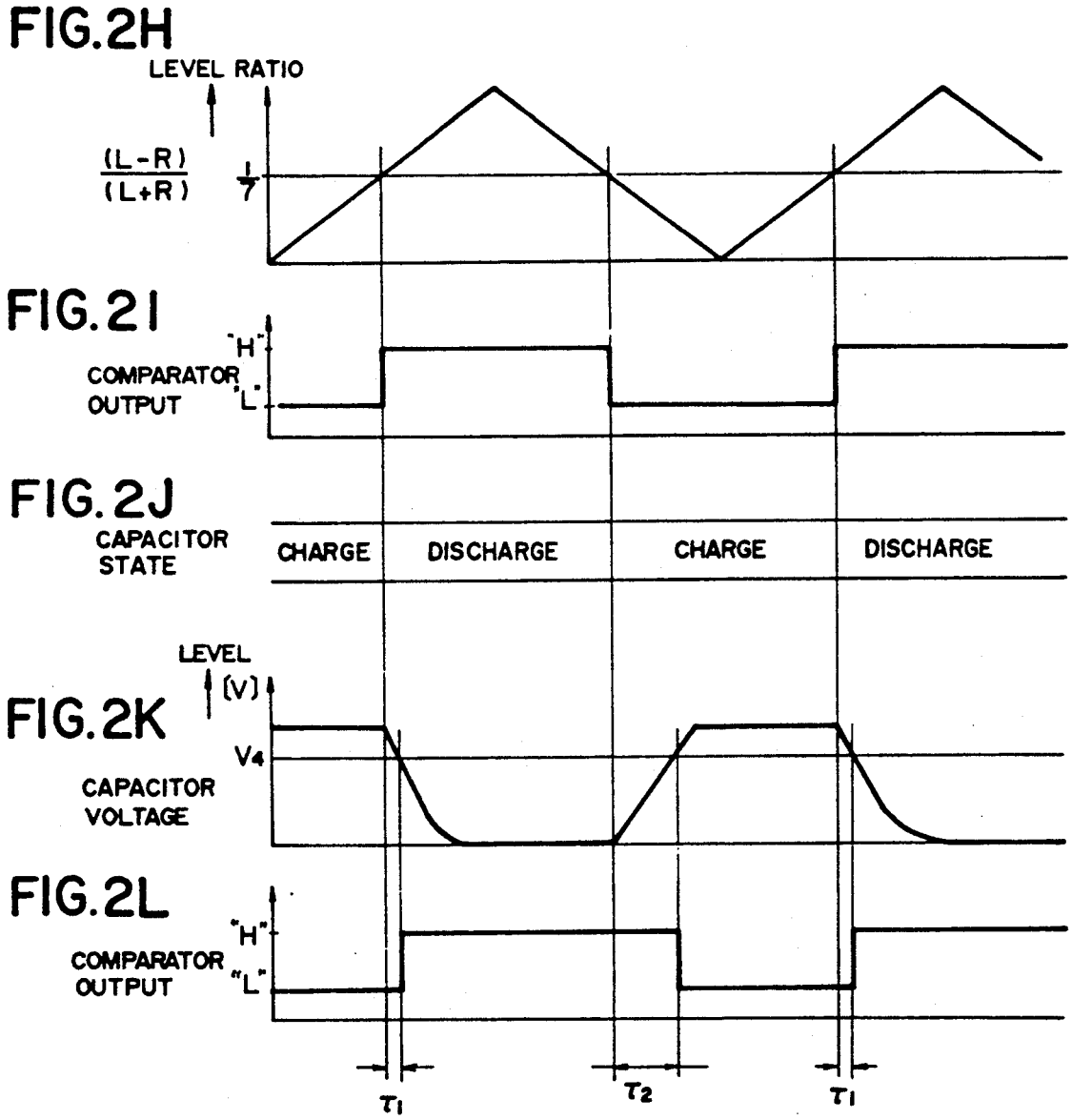
FIG. 2H shows the waveform of a signal representing the level ratio of $(L-R)/(L+R)$.
FIG. 2I shows the waveform of an output signal from a fourth comparator.
FIG. 2J shows a charge period and a discharge period of a capacitor.
FIG. 2K shows the waveform of a terminal voltage of the capacitor.
FIG. 2L shows the waveform of an output signal from a fifth comparator.

Subsequently a level difference signal representing the level of the difference signal (L−R) between the two-channel input audio signals (L, R), such as the output signal of the peak holding circuit 17, is fed to a noninverting (+) input terminal of a comparator (level discriminator) 31. Meanwhile a level sum signal representing the level of the sum signal (L+R), such as the output signal of the peak holding circuit 18, is fed via an attenuator 32 to an inverting (−) input terminal of the comparator 24. The attenuator 32 serves to attenuate the input signal level to 1/7 for example. The switching threshold value (discrimination level) of the comparator (level discriminator) 31 becomes 1/7 in case the level ratio (L−R)/(L+R) of the difference signal (L−R) and the sum signal (L+R) is such as shown in FIG. 2H, so that the output of the comparator 31 becomes such as shown in FIG. 2I. In the comparison output signal thus obtained, its high level ("H") and low level ("L") correspond to stereo and monaural, respectively.

According to the above method, generally the level of the signal component (L−R) is compared with the level of the signal component (L+R), and the audio input is regarded as a stereo signal when the ratio of the component (L−R) to the component (L+R) is in excess of a predetermined value (e.g., 1/5 to 1/9). The component (L+R) of the audio input signal is greater in level than the component (L−R) thereof, and any error derived from the direct-current offset and so forth can be minimized more effectively by attenuating the component (L+R) than by amplifying the component (L−R). Taking such a fact into consideration, this embodiment is so contrived that the attenuator 32 is connected to one input terminal of the comparator 31 for the component (L+R), so as to attain the predetermined level ratio described above.

The output signal of the comparator 31 is supplied to a delay circuit 34 where the delay time is different depending on the rise and fall of the signal supplied thereto. The delay circuit 34 comprises a switch 35 controlled to be turned on or off in response to the output signal of the comparator 31, a resistor 36 connected at one terminal thereof to the switch 35 and having a resistance R, a current source 37 connected to the other terminal of the resistor 36 and causing a flow of a current $I_0$, and a capacitor 38 connected at one terminal thereof to a junction between the resistor 36 and the current source 37 and having a capacitance C. In this circuit configuration, the respective other terminals of the switch 35 and the capacitor 38 are grounded. The terminal voltage of the capacitor 38 is supplied to the inverting (−) input terminal of the comparator 39 and then is compared with a fourth reference voltage V4 supplied to the noninverting (+) input terminal of the comparator 39 for level discrimination.

In the delay circuit 34, when the switch 35 is in its off-state, the current $I_0$ from the current source 37 flows into the capacitor 38 to charge the same. Meanwhile when the switch 35 is in its on-state, the charge in the capacitor 38 is released therefrom via the resistor 36. In case the output of the comparator 31 is at a high level ("H"), the switch 35 is turned on so that the capacitor 38 is charged or discharged as shown in FIG. 2J in response to the output signal of FIG. 2I supplied from the comparator 31, whereby the terminal voltage of the capacitor 38 is changed as shown in FIG. 2K. Due to the level discrimination of the terminal voltage in FIG. 2K with the reference voltage V4, a delay output signal of FIG. 2L is obtained from the comparator 39. In the output signal of FIG. 2L, similarly to the aforementioned signal of FIG. 2I, its "H" and "L" correspond to stereo and monaural, respectively.

As obvious from FIG. 2L, the delay time $\tau 1$ in switching from monaural ("L") to stereo ("H") is set to be short as several ten milliseconds for example, and the delay time $\tau 2$ in switching from stereo ("H") to monaural ("L") is set to be long as several seconds for example. Such setting is based on the reason for attaining a condition that any momentary soundless state is ignored during detection of monaural, and the operation is responsive to any fast change in the input audio signal during detection of stereo.

In the embodiment of the present invention, the aforesaid reference voltage V4 is set to, e.g., 4.0 volts at a point closer to the upper limit (e.g. 5.2 volts) of the capacitor terminal voltage shown in FIG. 2K than to the lower limit (e.g. 0 volt) thereof, whereby the delay time $\tau 1$ at the rise of the comparator output signal I (at the rise of the delay output signal L) is rendered short, while the delay time $\tau 2$ at the fall thereof is rendered long. Practically, under the conditions where the resistance R is set to 56Ω, the current $I_0$ to 10 μA and the capacitance C to 10 μF respectively, the delay time $\tau 1$ at the rise is 0.16 second, and the delay time $\tau 2$ at the fall is 4 seconds. Besides the above, the delay times can be rendered different from each other by making the charge and discharge time constants of the capacitor 38 mutually different. Also a variety of changes and modifications may be contrived with regard to the relationship between the charge-discharge of the capacitor and the on-off action of the switch actuated in accordance with the output of the comparator 31, and further with regard to the relationship between the positive and negative polarities (inversion and noninversion) of the input terminals at the time of comparing the terminal voltage of the capacitor with the discrimination level V4. The essential point resides in that the respective circuit constants are so set as to select a short delay time at the detection of a stereo input and to select a long delay time at the detection of a monaural input.

The output signal of the delay circuit 34 is supplied to a three-input AND gate 27.

There is also supplied a stereo pilot signal from an input terminal 28 to the three-input AND gate 27. This pilot signal is obtained by detecting a stereo pilot signal inserted in a telecast signal, and represents stereo when it is at a high level ("H"). In case the audio signals supplied to the input terminals 11, 12 are any other than a telecast audio signal, the signal supplied to the input terminal 28 is turned to "H".

Therefore, the result of a final discrimination detection is output as stereo or "H" from an output terminal 29 only when the entire three stereo/monaural detections are regarded as stereo ("H"), inclusive of the detection based on the telecast stereo pilot signal by the three-input AND gate 27, the detection based on the output signal of the hysteresis discriminating circuitry 20, and the detection based on the output signal of the delay circuit 34. Thus, a complete final discrimination detection is accomplished by fully utilizing the individual advantages of the three kinds of stereo/monaural detections.

First in the detection based on the stereo pilot signal, the feature resides in that the absence of the pilot signal signifies monaural without fail. Meanwhile in the absolute level detection executed with a level discrimination of the difference signal (L−R) and/or a level discrimination of the sum signal (L+R), any momentary change in the input audio signal can be detected. And in the relative level detection executed with a level comparison of the difference signal (L−R) and the sum signal (L+R), the steady-state trend of the input can be detected. Therefore, an enhanced stereo/monaural discrimination detection can be performed more accurately and effectively than any operation with only one of such three kinds of detections.

The stereo/monaural detection output signal thus obtained is used as a stereo/monaural switching display signal or a switching signal for selecting a stereo sound field expansion mode or a monaural one in a sound field expander.

It is to be understood that the present invention is not limited merely to the above embodiment alone, and a variety of modifications thereof are contrivable as well. For example, the constitution may be so devised that the result of a final discriminative detection is attained by only one kind of stereo/monaural detection or by combining it with another kind of stereo/monaural detection. In another exemplary modification, the detection output obtained by level discrimination of the difference signal L−R may be supplied to the delay circuit 34.

As described hereinabove, according to the stereo/monaural detection apparatus of the present invention, the level difference between two-channel input audio signals is calculated, and the signal representing such level difference is discriminated with a predetermined hysteresis maintained to cause a hysteresis in the stereo/monaural detection. Therefore, an erroneous detection can be prevented even if the level difference is varied in a short time as in a case where the sound field is positioned at the center in stereo signals. Furthermore, since the operation in one direction (e.g., discriminative switching from stereo to monaural) during the hysteresis discrimination is inhibited in response to the signal obtained by discriminating the level sum of the input audio signals at a predetermined reference level, it becomes possible to avert instability of the detection when the input level is extremely feeble.

Besides the above, in the embodiment of the present invention, the result of a stereo/monaural detection acquired by delaying the result of the relative level discrimination based on the ratio of the level difference and the level sum is combined with the result of the absolute level discrimination to obtain a logical product thereof, and then a final stereo/monaural discriminative detection is executed in response to such logical product. Consequently, an improved stereo/monaural detection can be accomplished inclusive of the steady-state trend found by the relative level discrimination, in addition to any momentary change of the input audio signal found by the absolute level discrimination. Besides the above, the final stereo/monaural discrimination detection can be performed in combination with the result of the stereo/monaural detection based on a stereo pilot signal included in an input telecast signal, hence further enhancing the reliability and certainty of the detection result.

What is claimed is:

1. A stereo/monoaural detection apparatus comprising:

two-channel input terminals respectively supplied with two-channel audio signals;

a substracting circuit for subtracting one of said two-channel audio signals from the other and producing a difference signal; and hysteresis discriminating means supplied with the difference signal from said subtracting circuit for performing level discrimination on the difference signal and detecting when a level of the difference signal is above a first threshold level and detecting when a level of the difference signal is below a second, lower threshold level and including a hysteresis circuit for performing said level detecting with a hysteresis effect so that every crossing by the difference signal of the first and second thresholds does not produce a corresponding change in an output signal of said hysteresis discriminating means, said output signal having a first level when two-channel audio signals are stereo signals and a second level when said two-channel audio signals are monaural signals.

2. The apparatus according to claim 1, wherein said hysteresis discriminating means includes:

a first comparator connected between an output terminal of said substracting circuit to receive said difference signal and a first input terminal of said hysteresis circuit, and supplied with a first predetermined voltage for setting said first threshold level; and a second comparator connected between the output terminal of said subtracting circuit to receive said difference signal and a second input terminal of said hysteresis circuit, and supplied with a second predetermined voltage for setting said second threshold.

3. The apparatus according to claim 2, wherein said hysteresis discriminating means further comprises:

switching means connected between the output terminal of said second comparator and said second terminal of said hysteresis circuit for selectively inhibiting said hysteresis circuit in response to a control signal.

4. The apparatus according to claim 3, further comprising:

an adding circuit for adding said two-channel audio signals to each other and producing a sum signal;

a third comparator connected to an output terminal of said adding circuit for detecting when said sum signal is above a third threshold level and producing said control signal fed to said switching means.

5. The apparatus according to claim 4, further comprising an AND gate circuit connected to the output of said hysteresis discriminating means;

a fourth comparator connected to compare respective signals of said difference signal and said sum signal and producing an output when a level of said difference signal is above a level of said sum signal; and a delay circuit connected to the output of said fourth comparator and producing an output fed to a second input of said AND gate circuit a predetermined period of time after an output from said fourth comparator is produced, so that said AND gate circuit produces a stereo/monaural detection output signal.

6. The apparatus according to claim 5, further comprising an attenuator for attenuating said sum signal fed to said fourth comparator.

7. The apparatus according to claim 6, wherein said delay circuit comprises:

a fifth comparator producing said output of said delay circuit fed to said second input of said AND gate circuit; and a switch for connecting the output of said fourth comparator to one input of said fifth comparator after a predetermined time delay, said fifth comparator connected to a fourth threshold level and producing said output signal fed to said second input of said AND gate when said switch output is less than said fourth threshold level.

8. The apparatus according to claim 7, wherein said AND gate circuit has a third input connected to a stereo pilot signal present in said two-channel audio signals.

9. The apparatus of claim 4, further comprising a first peak holding circuit having a first predetermined time constant and connected for feeding said difference signal to said hysteresis discriminating means; and a second peak holding circuit having a second predetermined time constant and connected for feeding said sum signal to said third comparator.

10. The apparatus of claim 9, wherein said second predetermined time constant is between 1.3 to 1.5 times longer than said first predetermined time constant.

11. The apparatus of claim 10, wherein said hysteresis circuit comprises an S-R flip-flop circuit connected to be set by the output of said first comparator and to be reset by the output of said switching means.

* * * * *

UNITED STATES PATENT AND TRADEMARK OFFICE

CERTIFICATE OF CORRECTION

PATENT NO. : 5,210,796

DATED : May 11, 1993

INVENTOR(S) : Atsushi Hirabayashi, Kenji Komori and Kyoichi Murakami

It is certified that error appears in the above-indentified patent and that said Letters Patent is hereby corrected as shown below:

Col. 9, line 21, before"two" insert --said--
Col. 10, line 8, change "signals" to --levels--

Signed and Sealed this

Nineteenth Day of July, 1994

*Attest:*

Bruce Lehman

BRUCE LEHMAN

*Attesting Officer*

*Commissioner of Patents and Trademarks*